United States Patent [19]

Näslund

[11] Patent Number: 4,850,824

[45] Date of Patent: Jul. 25, 1989

[54] ARRANGEMENT FOR CONTROL OF THE STROKE LENGTH

[75] Inventor: Ulf W. Näslund, Huskvarna, Sweden

[73] Assignee: Aktiebolaget Electrolux, Stockholm, Sweden

[21] Appl. No.: 95,453

[22] Filed: Sep. 11, 1987

[30] Foreign Application Priority Data

Sep. 29, 1986 [SE] Sweden ..... 86041159

[51] Int. Cl.[4] ..... F04B 7/06

[52] U.S. Cl. ..... 417/500; 92/13

[58] Field of Search ..... 417/492, 500; 92/13, 92/13.7, 13.6, 13.4, 13.2, 13.5, 13.51; 184/33, 35; 123/449; 74/831, 838, 839, 479, 502

[56] References Cited

U.S. PATENT DOCUMENTS

| | | | |
|---|---|---|---|
| 2,104,590 | 1/1938 | Hill | 417/500 |
| 2,411,705 | 11/1946 | Benjamin | 92/13.5 X |
| 2,836,987 | 6/1958 | Gavbatz | 74/479 |
| 3,162,335 | 12/1964 | Kogan et al. | 92/13.2 X |
| 4,678,411 | 7/1987 | Wieland | 417/500 |

FOREIGN PATENT DOCUMENTS

| | | | |
|---|---|---|---|
| 136478 | 2/1950 | Australia | 92/13.5 |
| 996292 | 12/1951 | France | 417/500 |
| 245409 | 1/1926 | United Kingdom | 184/33 |
| 801667 | 9/1958 | United Kingdom | 184/33 |

*Primary Examiner*—Leonard E. Smith

*Attorney, Agent, or Firm*—Pearne, Gordon, McCoy & Granger

[57] ABSTRACT

The invention relates to an arrangement of an oil pump for manual control of the oil quantity and consists of a supplement to the known way of operating the piston stroke with a control member (28) which, when working, is capable of guiding a setting of a maximum movement of the pump piston (11).

4 Claims, 1 Drawing Sheet

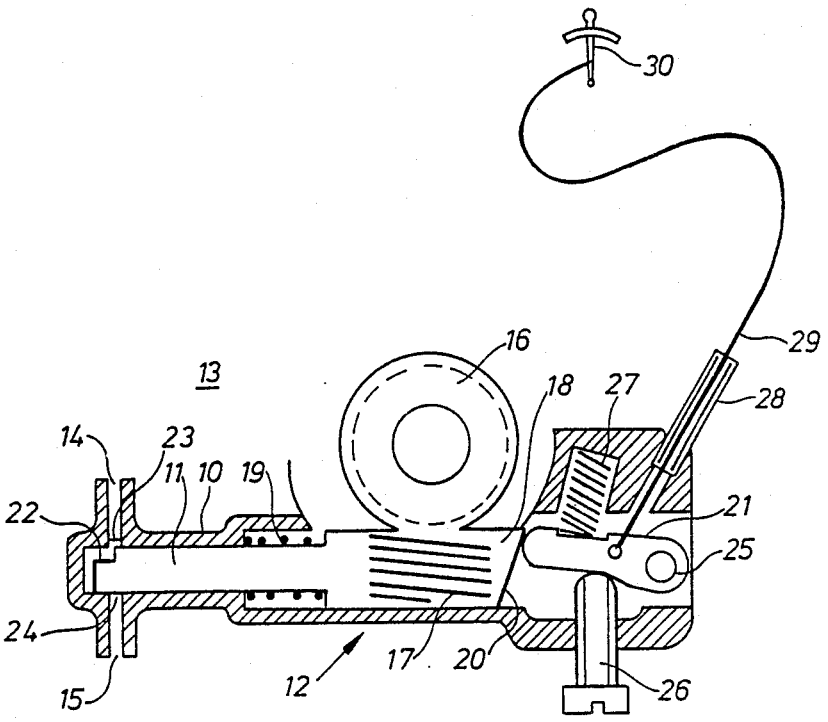
30
29
28
16
13
18
27
14
23
11
10
19
22
21
25
24
17
20
12
26
15

ARRANGEMENT FOR CONTROL OF THE STROKE LENGTH

The present invention relates to an arrangement for control of the stroke length of pump piston, where the quantity of liquid, delivered by the pump, shall be controlled.

BACKGROUND OF THE INVENTION

From prior art it is known, for instance, how to operate an oil pump directly from an engine shaft or a coupling therefrom. In special circumstances the need of liquid might, however, be larger than the normal capacity of the used pump. As a remedy for that a hand-operated pump was previously introduced giving extra liquid for each pump stroke the operator made. A separate hand-operated pump must be placed easily accessible and have its own connections from the tank to the position of supply. A simplification of the problem has been possible by introducing a control member for the capacity of the pump which is easily checked by the operator during operation, and such a member is utilized in the present invention.

BRIEF DESCRIPTION OF THE DRAWING

An embodiment of the arrangement according to the invention will now be described in the following description with reference to the accompanying DRAWING showing a longitudinal section of an oil pump.

DESCRIPTION OF THE PREFERRED EMBODIMENT

An oil pump of the construction in question has a rotatably and displaceably journalled piston 11 in a cylinder 10. All parts of the pump are accommodated in a pump housing referred to generally by the numeral 12 which is mounted on a side of the crankhouse of an engine 13. In the wall of the pump housing there are channels 14, 15 leading to the place of lubrication and to the oil tank, respectively. The pump is, as an example, operated by an angle gear with pinions 16 and 17 which have oblique teeth with a very small pitch. Therefore, when the drive gear 16 rotates rapidly a large gear reduction takes place so that the piston 11 with the piston rod 18 and a helical spring 19 fitted on it rotates slowly. During the rotation an oblique surface 20 of the piston slides towards the end of a lever 21 in the cylinder and from the force of the spring against the gear 17 the piston gets an axial movement of a length corresponding to the relative positions of the oblique surface as well as of the layer. The movement is in one direction guided by the spring and in the other by the oblique surface. The pumping effect is achieved by the axial movement mentioned and from the valve function caused by a bevel cutting 22 as well as by some ports 23, 24 in the channels 14, 15 of the pump housing 12. When the piston is fully pressed into the cylinder as shown on the figure the bevel cutting stands inclined upwards against the output channel 14 which then is open towards the cylinder. Twisted 180° from there the bevel cutting stands towards the input channel 15 when the piston is somewhat retracted in the cylinder. This type of oil pump is well known and used in chain saws.

The previously mentioned axial movement is made by the piston's contact with the lever 21 which is swingably journalled on a pin 25 in the cylinder. By means of different angular settings of the lever the axial movement can be adjusted from 0, when the lever stands against the center of the oblique surface 20, to a maximum rate when the lever is put against the periphery of the surface. The lever is normally set in a position between these extreme positions (shown in the FIGURE), and that setting is effected by means of an adjusting screw 26 which can be reached with a tool outside the pump house. The lever is kept pressing against the inner end of the screw by a pressure spring 27 in the pump house.

The need for extra oil to the place of lubrication mentioned in the introduction is secured in the arrangement by an extra control member 28 which guides the lever out against the periphery of the oblique surface. The control member in question is shaped as a Bowden cable 29 leading to a hand lever 30 placed at the rest of control members of the machine. By means of the hand lever the operator can then easily set the lever 21 in the outer position at the periphery of the oblique surface and in that way increase to maximum the piston stroke of the pump. With the supplementary control member 28 it will then be possible to pump extra oil to the place of lubrication at occasions determined by the operator, when the normal supply is unsatisfactory. As soon as the increased need will cease the operator sets back the hand lever in its first position.

I claim:

1. In an arrangement for control of the stroke length of a piston for a pump rotatably and displaceably in a cylinder, a pump housing, a rotational drive assembly for said piston having an oblique surface at one end, a lever pivoted in said pump housing, a lever adjusting means including a member for applying force to one side of said lever to pivot the same and resilient means having one end engaging said pump housing, and the other end engaging the opposite side of said lever, said lever being so mounted and arranged to produce an axial movement when said piston rotates, and said lever having a setting range at one end between the center and the periphery of said oblique surface, said lever adjusting means being capable of a setting range to an extreme position at the periphery of said oblique surface.

2. An arrangement as claimed in claim 1 wherein the free end of said lever is radially swingable over said oblique surface from the center to the periphery thereof.

3. An arrangement as claimed in claim 1 wherein said control member further comprises a Bowden cable which is fixed at one end to said lever, and an operating device fixed to the other end thereof.

4. An arrangement as claimed in claim 3 wherein said Bowden cable is provided with an easily reachable operating member.

* * * * *